US006112375A

United States Patent [19]

Yuki et al.

[11] Patent Number: 6,112,375

[45] Date of Patent: Sep. 5, 2000

[54] SLIDER FOR SLIDE FASTENER WITH AUTOMATIC LOCKING MECHANISM

[75] Inventors: Kenji Yuki; Koji Muratsubaki; Hiroo Minami, all of Toyama, Japan

[73] Assignee: YKK Corporation, Tokyo, Japan

[21] Appl. No.: 09/052,140

[22] Filed: Mar. 31, 1998

[30] Foreign Application Priority Data

Mar. 31, 1997 [JP] Japan ..... 9-080629

[51] Int. Cl.[7] ..... A44B 19/30

[52] U.S. Cl. ..... 24/418; 24/429

[58] Field of Search ..... 24/418, 421, 423, 24/424, 386, 387, 436, 431, 415, 403

[56] References Cited

U.S. PATENT DOCUMENTS

| | | | |
|---|---|---|---|
| 2,071,544 | 2/1937 | Kroll | 24/418 X |
| 2,277,503 | 3/1942 | Pickens . | |
| 2,277,978 | 3/1942 | Hoflich . | |
| 2,303,750 | 12/1942 | Marinsky . | |
| 3,813,736 | 6/1974 | Fukuroi | 24/424 |
| 4,976,014 | 12/1990 | Akashi et al. | 24/429 X |
| 5,195,221 | 3/1993 | Kanamaru et al. | 24/429 |
| 5,625,927 | 5/1997 | Chu | 24/418 X |

FOREIGN PATENT DOCUMENTS 0 576 985 A1 1/1994 European Pat. Off. .

2 425 209 12/1979 France .

*Primary Examiner*—Anthony Knight
*Assistant Examiner*—Robert J. Sandy
*Attorney, Agent, or Firm*—Hill & Simpson

[57] ABSTRACT

A slider for a slide fastener with an automatic locking mechanism comprises a small number of components and hence can be assembled and operated with ease. A slider body of the slider has a receiving hole for receiving a resilient plate running in parallel with a guide groove and arranged in the upper wing plate of the slider body. The receiving hole has an enlarged open section arranged at the side of a rear opening and communicating with the guide groove to a claw receiving hole, and is formed to have a narrow tubular shape above a guide post. A wide groove is arranged along a lateral side of the receiving hole with a gap therebetween. A through hole is arranged to perpendicularly cross the receiving hole at the middle thereof. The resilient plate is introduced into the receiving hole from the U-shaped spring side for mutual engagement and the actuating portion of the operating member is introduced into the through hole until the cam surface resiliently abuts the actuated portion of the resilient plate and the spring plates extending from the operating portion exposed from the upper wing plate are arranged in the wide groove so that the operating member is held in place and resiliently movable back and forth. As the operating portion is operated, the cam surface raises the resilient plate and hence the locking claw to allow the slider to slide.

10 Claims, 6 Drawing Sheets

SLIDER FOR SLIDE FASTENER WITH AUTOMATIC LOCKING MECHANISM

BACKGROUND OF THE INVENTION

This invention relates to a slider for a slide fastener with an automatic locking mechanism having no pull tab and adapted to be suitably used for a bag, a shoe, a training wear or the like. In use, such a slider can be locked and unlocked simply by operating an operating member the locking mechanism arranged at a lateral side of the slider body.

A known slider for a slide fastener with an automatic locking mechanism as disclosed in U.S. Pat. No. 2,071,544 comprises a slider body having a flat casing integrally formed with and arranged on the slider body and a latching release element having an end pivotably anchored to a pin within the casing and the other end disposed outside the casing such that a resilient locking lug is disengaged from a guide element by inwardly depressing the release element to make the slider freely slidable.

A known slider for a slide fastener with an automatic locking mechanism as described above comprises a large number of components and has a complicated mechanism and therefore it involves a cumbersome assembling process. Additionally, such a slider is not adapted to downsizing by any means and does not have a neat appearance so that it cannot practically does not have a neat appearance so that it cannot practically be used for an ordinary-sized fastener chain. Still additionally, such a slider does not move smoothly and hence can hardly find practical applications.

In view of the above identified problems of the prior art, it is therefore a first object of the present invention to provide a slider for a slide fastener with an automatic locking mechanism having no pull tab that can easily be assembled from a minimal number of components and is hence adapted to down-sizing, and the automatic locking mechanism has a simply configuration to allow the slider to be easily and smoothly operated without troubles.

A second object of the present invention is to provide a slider for a slide fastener with an automatic locking mechanism having no pull tab as defined above that additionally comprises a specifically designed space for accommodating the spring of the automatic locking mechanism in order to make the spring operate effectively for realizing adequate locking operation of the locking mechanism.

A third object of the present invention is to provide a slider for a slide fastener with an automatic locking mechanism having no pull tab as defined above, which is so configured that a locking claw can be brought into engagement and disengagement with the fastener elements by pushing a lateral side of the slider.

A fourth object of the present invention is to provide a slider for a slide fastener with an automatic locking mechanism having no pull tab as defined above, which is so configured that the automatic locking mechanism can be operated for locking/releasing the locking claw reliably by means of an operating member arranged at a lateral side of the slider and having a simple configuration.

A fifth object of the present invention is to provide a slider for a slide fastener with an automatic locking mechanism having no pull tab as defined above, which is so configured that the locking claw can be brought into engagement and disengagement with the fastener elements simply by pushing the front opening side of the slider.

A Sixth object of the present invention are to provide a slider for a slide fastener with an automatic locking mechanism having no pull tab as defined above, which is so configured that the automatic locking mechanism can be operated for locking/releasing the locking claw reliably by means of a specifically configured operating member simply by pushing the front opening side of the slider.

A seventh object of the present invention is to provide a slider for a slide fastener with an automatic locking mechanism having no pull tab as defined above, which has an esthetically comfortable appearance and can be manufactured in a simple manner.

SUMMARY OF THE INVENTION

According to the invention, the above first object is achieved by providing a slider for a slide fastener with an automatic locking mechanism comprising a slider body having an upper wing plate, an operating member and a resilient plate formed by pressing. In the slider, a receiving hole for receiving the resilient plate is formed in said upper wing plate of the slider body from a front opening to a rear opening. The resilient plate is provided with a locking claw at an end, a U-shaped spring at the opposite end and an actuated portion pressed to have a trapezoid shape at the middle thereof, the locking claw of the resilient plate being retractably arranged in a guide groove provided in a lower wing plate of the slider body for guiding fastener elements. And the operating member is provided with an actuating portion which is to be accommodated in the upper wing plate and held in sliding contact with the raised actuated portion of the resilient plate to operate the locking claw. And the operating member is horizontally arranged so as to be movable back and forth relative to the slider body. With such an arrangement, the slider is made to comprise a small number of components and hence can be assembled with ease so that it is particularly adapted to downsizing and therefore can find a variety of applications without trouble and it can be operated very smoothly.

The second object is achieved by providing a slider in which, in addition to the above, the receiving hole formed in the slider body has an enlarged open section extending from the rear opening of the slider body to a claw receiving hole and has a narrow tubular shape arranged above a guide post of the slider body into which the U-shaped spring is introduced, and the U-shaped spring is provided with lugs oppositely extending at a front end thereof and engaged with a corresponding edge of the receiving hole. With this arrangement, the resilient plate can be reliably accommodated in the slider body with ease and without the fear of coming out so that the slider can reliably operate for a prolonged period of time.

The third object is achieved by providing a slider in which, in addition to the above, a through hole is formed in a manner to perpendicularly cross the longitudinal receiving hole of the slider body, the operating member being introduced into the through hole so as to allow the operating member laterally slidable, and a cam surface is formed on the actuating portion of the operating member and held in sliding contact with the actuated portion of the resilient plate to operate the locking claw. With this arrangement, the locking claw of the automatic locking mechanism of the slider having no pull tab can be reliably operated for locking/releasing simply by pushing it from a lateral side of the slider.

The fourth object is achieved by providing a slider in which, in addition to the features of the slider to achieve the third object, thin and resilient legs are formed to have a U-shape extending from a front end of the cam surface of the actuating portion of the operating member, the thin and resilient legs are provided with projections at respective front ends thereof to engage inward protuberances arranged at the middle of the through hole running through the slider body, and spring plates are provided to extend respectively from opposite lateral ends of an operating portion exposed from the upper wing plate and engage a wide groove formed in the through hole so as to give the operating member resiliency. With this arrangement, the operating member of the automatic locking mechanism can be mounted to the slider easily and the operating member can be operated by pushing a lateral side of the slider against resiliency in an easy and reliable manner.

The fifth object is achieved by providing a slider in which, in addition to the features of the slider to achieve the second object, a pair of partition walls are arranged oppositely along both sides of the narrow tubular receiving hole bored above the guide post of the slider body with a cavity section extending from the outside of the partition walls and from the claw receiving hole forwards, i.e. toward the front opening and the operating member is inserted in the cavity section and held to be movable back and forth, said operating member having parallel legs extending from an operating portion exposed from the upper wing plate and bent at their front ends to produce bent sections operating as actuating portion, the actuating portion being in sliding contact with the actuated portion of the resilient plate to operate the locking claw. With this arrangement, the automatic locking mechanism can be operated easily and smoothly by pushing a front opening side of the slider.

The sixth object is achieved by providing a slider in which, in addition to the features of the slider to achieve the fifth object, the legs extending from the operating portion of the operating member in parallel with each other are made resilient and bent at the front ends to produce the bent sections, the bent sections being held in contact with each other and having respective engaging protuberances for resiliently engaging each other to operate as the actuating portion, the actuating portion being in sliding contact with the actuated portion of the resilient plate to operate the locking claw. With this arrangement, the actuating portion of the operating member for actuating the automatic locking mechanism can be assembled in a simple manner and made very robust to withstand a prolonged use.

The sixth object is achieved by alternatively providing a slider in which the legs extending from the operating portion of the operating member in parallel with each other are bent at the front ends to produce the bent sections, the legs being resiliently deformed and introduced into the cavity section so as to arrange the bent sections vis-a-vis to operate as actuating portion, the actuating portion being in sliding contact with the actuated portion of the resilient plate to operate the locking claw. With this arrangement, the actuating portion of the operating member for operating the automatic locking mechanism can be realized by simple resiliently deformable means.

The seventh object is achieved by providing a slider in which, in addition to the features of the slider to achieve the fifth object, a guard section is arranged above the cavity section at the side of a front opening of the upper wing plate of the slider body, extending forwardly and outwardly to cover a gap between the operating portion of the operating member fitted into the slider body and the slider body. With this arrangement, the slider can be made to show an esthetically excellent appearance and provide a wide variety of applications.

DESCRIPTION OF THE PREFERRED EMBODIMENTS OF THE INVENTION

Now, the present invention will be described by referring to the accompanying drawings that illustrate preferred embodiments of slider for a slide fastener with an automatic locking mechanism having no pull tab according to the invention.

Figure 1:
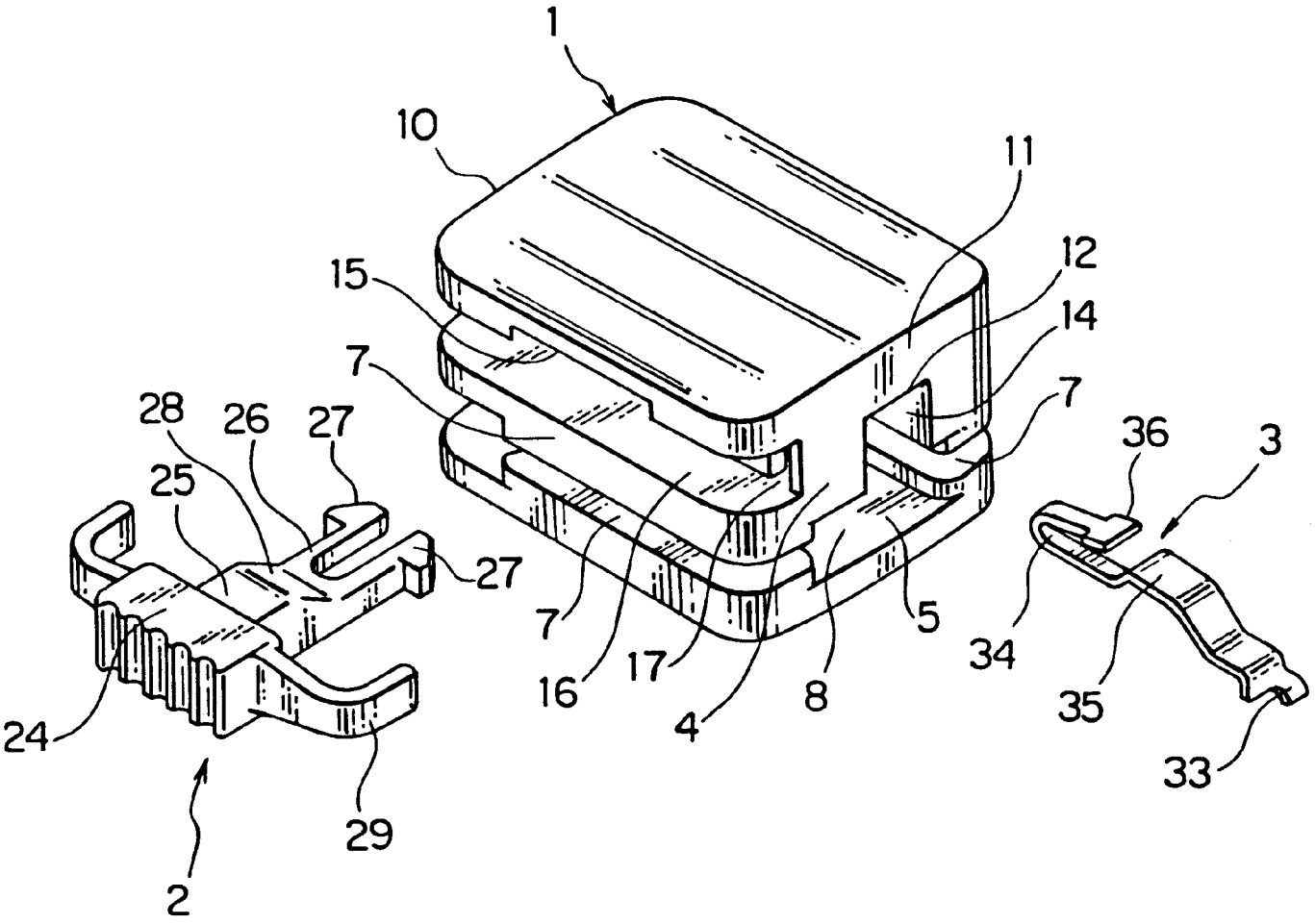
FIG. 1 is an exploded perspective view of an embodiment of slider for a slide fastener with an automatic locking mechanism having no pull tab according to the invention.
Figure 2:
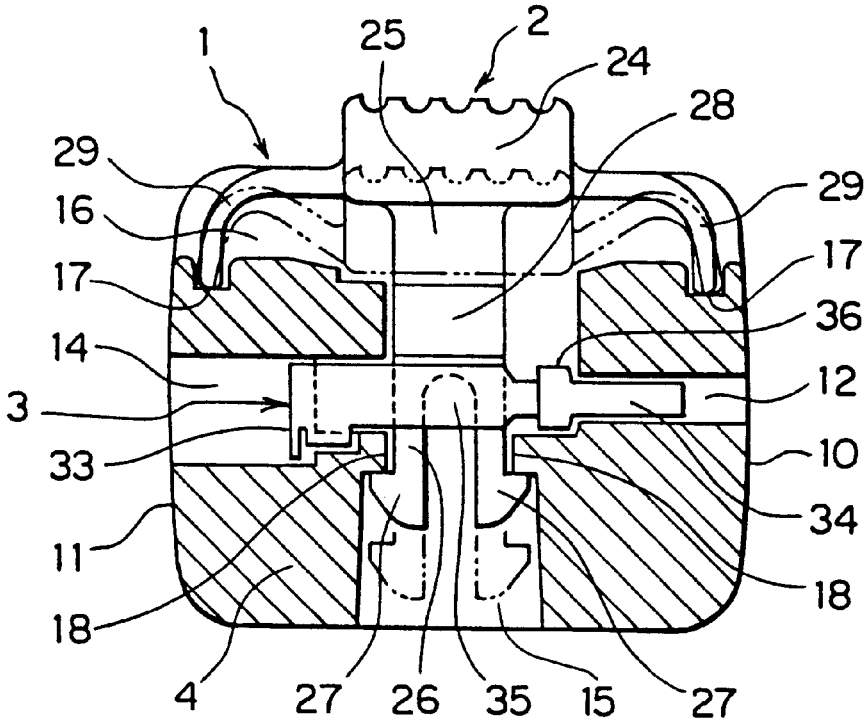
FIG. 2 is a cross sectional plan view of the embodiment of FIG. 1.
Figure 4:
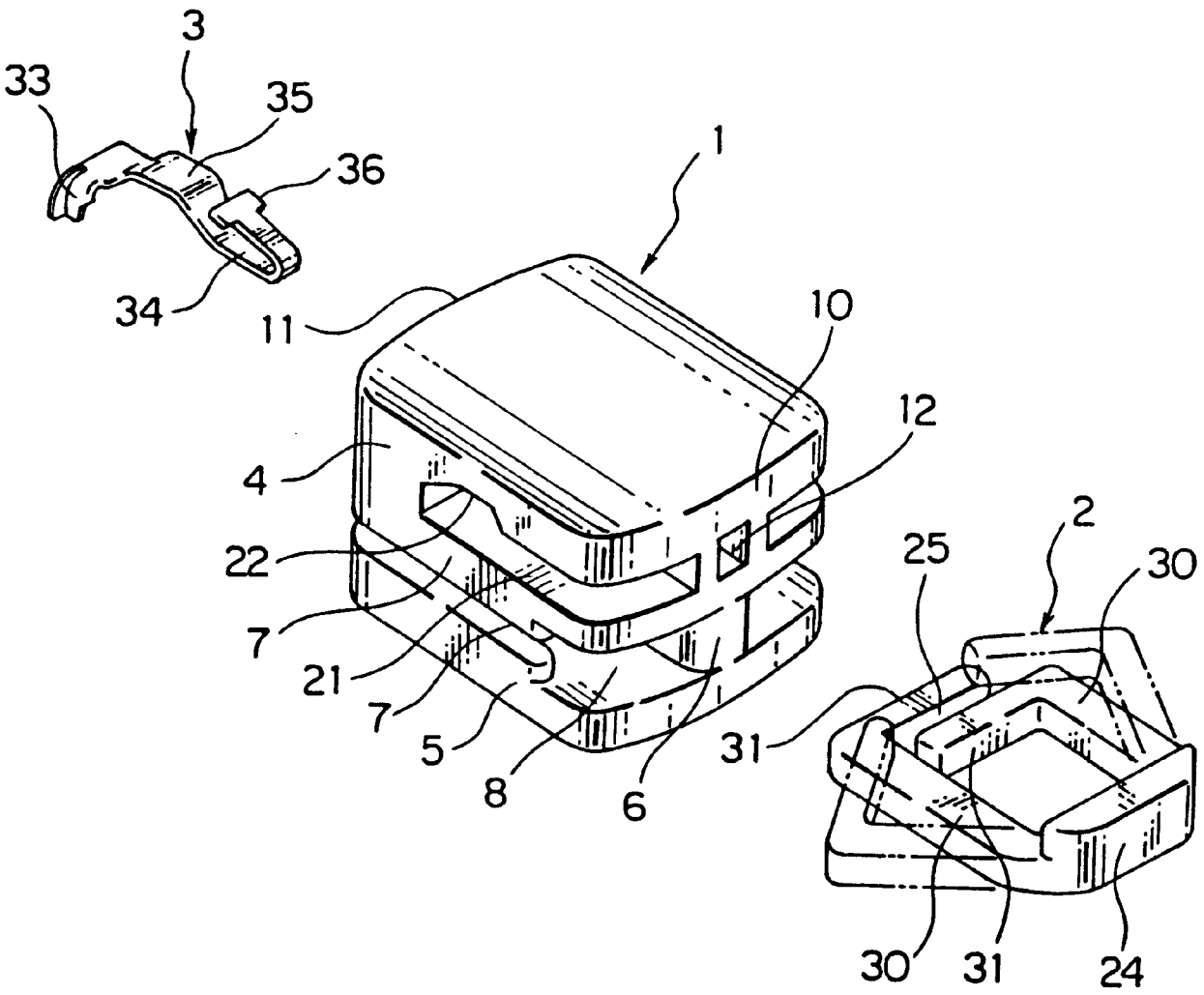
FIG. 4 is an exploded perspective view of another embodiment of slider for a slide fastener with an automatic locking mechanism having no pull tab according to the invention.
Figure 5:
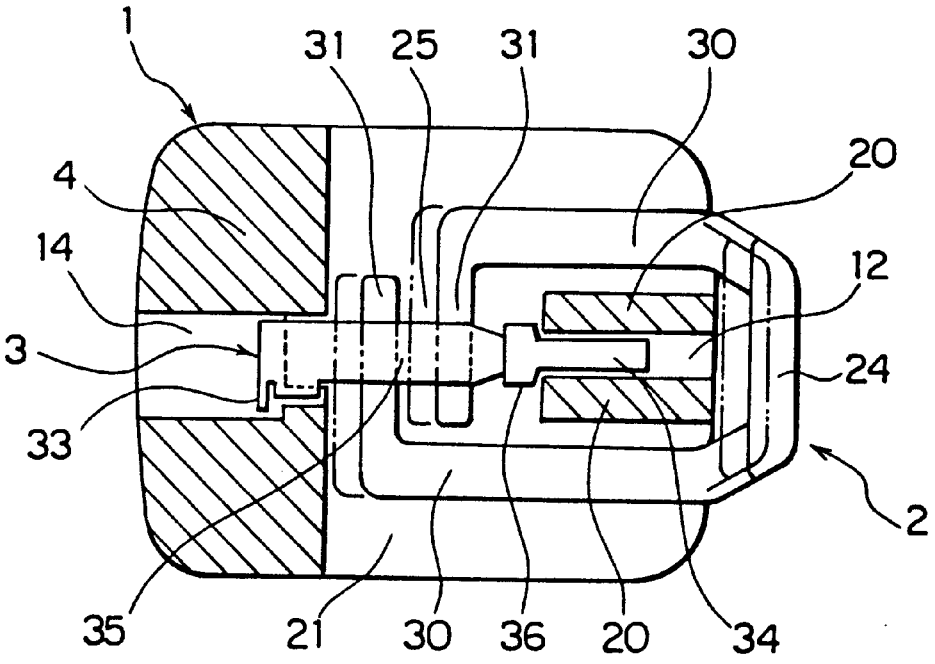
FIG. 5 is a cross sectional plan view of the embodiment of FIG. 4.

Referring to FIGS. 1 and 4, a slider for a slide fastener with an automatic locking mechanism having no pull tab according to the invention basically comprises a slider body 1, an operating member 2 and a resilient plate 3, of which the slider body 1 and the operating member 2 are made of thermoplastic resin such as polyamide, polyacetal polypropylene or polybutyleneterephthalate and formed by injection molding. Alternatively, the slider body 1 may be made of metal such as an aluminum alloy or a zinc alloy and formed by die casting and combined with the operating member 2 made of thermoplastic resin.

Referring firstly to FIG. 1, the slider body 1 of the illustrated embodiment of slider with an automatic locking mechanism is a substantially rectangularly parallelopiped and has an upper wing plate 4 and a lower wing plate 5 that are linked to each other by way of a guide post 6 at the side of a front opening 10. Additionally, the slider body 1 has guide flanges 7 for guiding fastener elements, formed on the upper and lower wing plates 4 and 5 at their lateral edges and a guide groove 8 defined by the guide flanges and the upper and lower wing plates 4 and 5, for guiding fastener elements. Note that the slider body 1 may have guide flange 7 arranged on lateral sides of only one of the wing plates depending on the type of the fastener elements.

Figure 3:
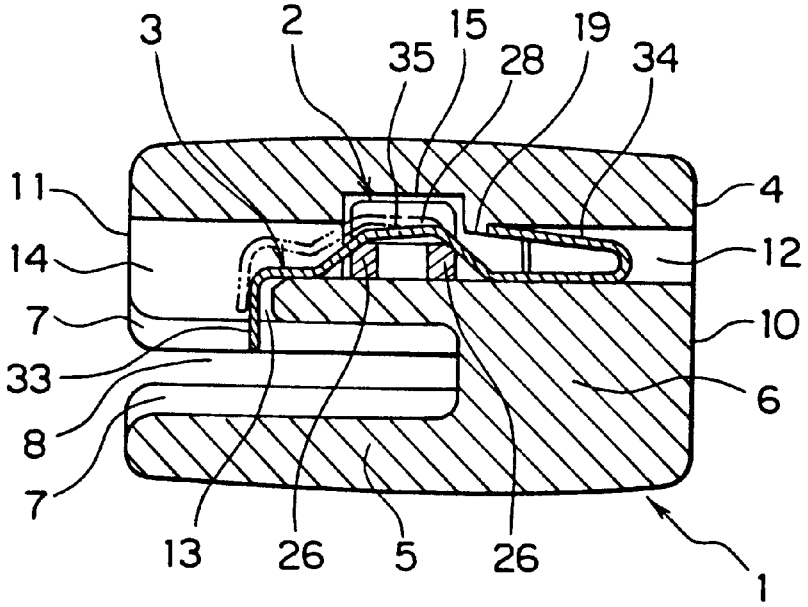
FIG. 3 is a cross sectional side view of the embodiment of FIG. 1.

Referring to FIG. 3, the upper wing plate 4 takes a significantly thick and has a receiving hole 12 extending from the front opening 10 to the rear opening 11 for receiving the resilient plate 3, which receiving hole 12 has an enlarged open section 14 at the rear end of the slider body 1 that extends horizontally from a rear opening 11 to a claw receiving hole 13 and communicates with the guide groove 8 while the receiving hole 12 has a small diameter above the guide post 6 and is configured to receive snugly a U-shaped spring 34 of the resilient plate 3. The slider body 1 additionally has a horizontal through hole 15 extending perpendicularly to the receiving hole 12 crossing at the middle of the latter and the top wall of the receiving hole 12 has a small downward protuberance 19 at the crossing with the through hole 15 to hold the free front end of the U-shaped spring 34 of the resilient plate 3.

As seen from FIG. 3, the through hole 15 has a top wall located higher than that of the receiving hole 12 so that it can receive easily both the resilient plate 3 and the operating member 2 and allow them to operate smoothly. At an end, the through hole 15 communicates with a wide groove 16 formed longitudinally along a lateral side of the slider body 1 to receive spring plates 29 of the operating member 2. The wide groove 16 has at the opposite ends thereof a pair of recesses 17 for engagedly receiving the corresponding respective ends of the spring plates 29. Additionally, the through hole 15 is upwardly extended at and near the lateral wall of the slider body 1 along which the wide groove 16 is formed for inserting an operating portion 24 of the operating member 2. On the other hand, the through hole 15 is extended at the opposite end thereof and has a pair of inward protuberances 18 located close to the receiving hole 12 and arranged on the respective walls thereof in order to engage respective projections 27 provided on legs 26 of the operating member 2.

The operating member 2 has a profile like a bow gun and has at an end the thick operating portion 24, from which an actuating portion 25 extends toward the U-shaped front end defining the pair of legs 26. The legs 26 are resiliently deformable and has the respective lateral triangular projections 27 that are to be engaged with the corresponding protuberances 18 of the through hole 15 respectively in order to prevent the operating member 2 from being removed from the through hole 15.

The actuating portion 25 has a slanting cam surface 28 at the middle thereof, which cam surface 28 is adapted to act on an actuated portion 35 of the resilient plate 3 in order to raise and lower the latter when a locking claw 33 of the resilient plate 3 is to be released from the guide groove 8. The operating portion 24 has the pair of curved spring plates 29 extending from the opposite sides thereof, which spring plates 29 are received in the wide groove 16 of the upper wing plate 4 and engage the respective recesses 17 at the front ends thereof in order to make the operating member 2 resiliently move back and forth relative to the slider body 1.

The resilient plate 3 is prepared from a metal strip by means of a press and has the locking claw 33 at an end and the U-shaped spring 34 at the other end with the upwardly raised actuated portion 35 arranged therebetween. The U-shaped spring 34 has a width slightly smaller than the remaining portion of the resilient plate 3 and is adapted to be received in the narrow tubular receiving hole 12 with a pair of lugs 36 extending oppositely from its front end to be anchored by the corresponding edge of the narrow tubular receiving hole 12 and its end engages with the small protuberance 19 disposed on the top wall of the receiving hole 12 in order to prevent the resilient plate 3 from coming out of the receiving hole 12.

The slider body 1, the operating member 2 and the resilient plate 3 that are configured as described above are assembled in the following manner. Firstly, the spring 34 of the resilient plate 3 is introduced into the slider body 1 through the open section 14 until the front end and the lugs 36 of the resilient plate 3 become engaged with the small protuberance 19 and the edge of the small tubular receiving hole 12 respectively, thus the resilient plate 3 is set in position within the slider body 1. Under this condition, the legs 26 of the operating member 2 is introduced into the through hole 15 from the side of the slider body 1 where the wide groove 16 is formed so that the U-shaped legs 26 pass through between the bottom of the receiving hole 12 and the actuated portion 35 of the resilient plate 3 and the projections 27 forcedly pass through between the protuberances 18 of the through hole 15 until the projections 27 and the corresponding protuberances 18 become engaged with each other to prevent the operating member 2 from coming out of the slider body 1. At the same time, the front ends of the spring plates 29 laterally extending from the operating portion 24 are engaged with the corresponding recesses 17 of the wide groove 16 so that the operating member 2 may be moved resiliently within the slider body 1.

Once the slider is assembled and placed in position, it can be slidingly moved back and forth by holding the slider body 1 at the lateral sides and pushing the operating member 2 against its resilient resistance to push up the actuated portion 35 of the resilient plate 3 by the cam surface 28 of the operating member 2 until the locking claw 33 is retracted and released from corresponding fastener elements.

Now, the embodiment of slider with an automatic locking mechanism illustrated in FIG. 4 will be described. It also comprises a slider body 1, an operating member 2 and a resilient plate 3 and the slider body 1 has an upper wing plate 4 and a lower wing plate 5 that are linked to each other by way of a guide post 6 at the side of a front opening 10. Additionally, the slider body 1 has guide flanges 7 for guiding fastener elements formed, on the upper and lower wing plates 4 and 5 at their lateral edges and a guide groove 8 defined by the guide flanges and the upper and lower wing plates 4 and 5, for guiding the fastener elements.

Figure 6:
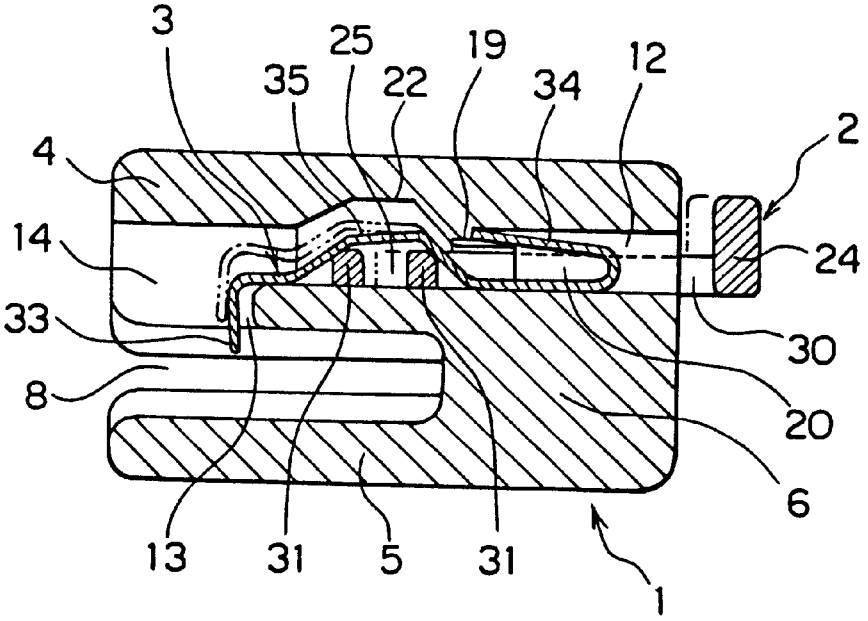
FIG. 6 is a cross sectional side view of the embodiment of FIG. 4.

Referring to FIG. 4, the upper wing plate 4 has a narrow tubular receiving hole 12 at the side of the front opening 10, which receiving hole 12 has an enlarged open section 14 at the rear end of the slider body 1 that extends horizontally from a rear opening 11 to a claw receiving hole 13. The narrow tubular receiving hole 12 above the guide post 6 communicates with a cavity section 21 horizontally extending on both sides of partition walls 20 up to the claw receiving hole 13, and the top wall of the cavity section 21 has a transversal groove 22 at a position closer to the rear opening 11 of the slider body 1, which transversal groove 22 has a profile adapted to receive both an actuating portion 25 of the operating member 2 and an actuated portion 35 of the resilient plate 3 without difficulty. As shown in FIG. 6, the top wall of the receiving hole 12 has a small downward protuberance 19 along the edge of the transversal groove 22 located close to the front opening 11 of the slider body 1 to hold the free front end of a U-shaped spring 34 of the resilient plate 3.

The operating member 2 has legs 30 extending from the respective lateral ends of a relatively thick operating portion 24 with the partition walls 20 arranged therebetween. The legs 30 are inwardly bent near the front ends to produce respective bent sections 31 that are arranged vis-a-vis relative to each other to form the actuating portion 25. For assembling the slider, the bent sections 31 are resiliently deformed and introduced into the cavity section 21 from the side of the front opening 10 of the slider body 1 until the bent sections 31 completely pass by the partition walls 20 and resiliently restore the original profiles in the transversal groove 22 to face each other once again and operate as the actuating portion 25.

Figure 7:
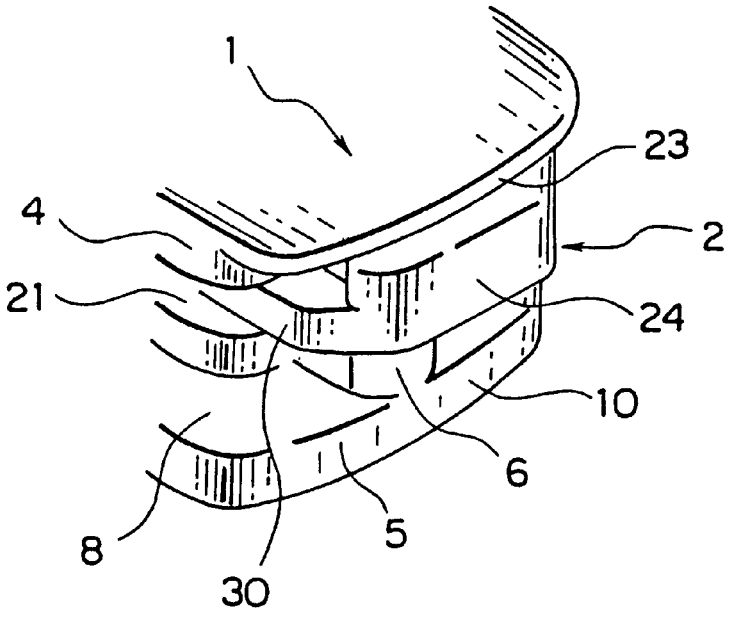
FIG. 7 is a fragmentary perspective view of a modified slider of the embodiment of FIG. 4.

In the embodiment of slider as shown in FIG. 7, the upper wing plate 4 of the slider body 1 has a guard section 23 at the side of the front opening 10 above the cavity section 21 in order to cover the operating member 2 fitted into the slider body 1 and adapted to move back and forth within the slider body 1 for esthetic reasons. With this arrangement, the operating portion 24 of the operating member 2 fitted to the cavity section 21 and exposed to the outside of the slider body 1 is made invisible from above by the guard section 23 to provide a visually comfortable slider having no pull tab.

Figure 8:
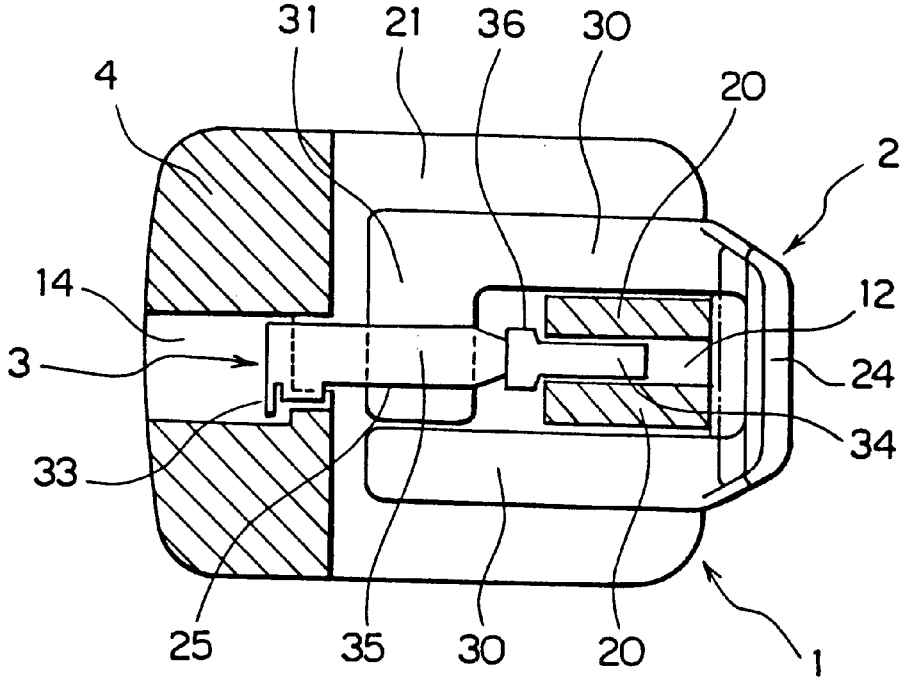
FIG. 8 is a cross sectional plan view of a modified operating member of the embodiment of FIG. 4.
Figure 9:
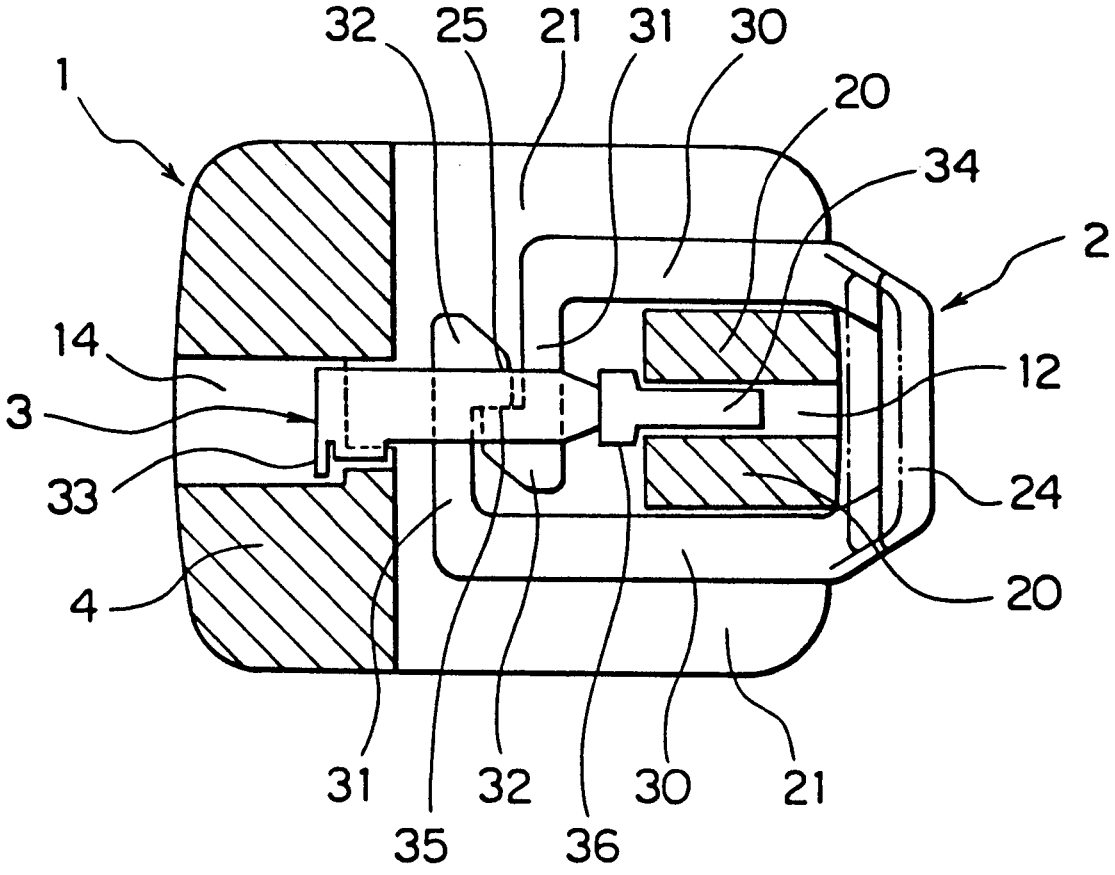
FIG. 9 is a cross sectional plan view of another modified operating member of the embodiment of FIG. 4.

FIG. 8 shows a cross sectional plan view of the operating member 2 having the legs 30, only one of which has the wide bent section 31 that operates as the actuating portion 25. The operating member 2 may be made free from any rocking motion when the legs 30 are arranged to slidingly move along the respective partition walls 20. FIG. 9 shows a still alternative configuration of the legs 30 of the operating member 2. The bent sections 31 of the legs 30 are resiliently held in contact with each other and has respective triangular engaging protuberances 32 that resiliently engage each other to operate as the actuating portion 25. The partition walls 20 may be made relatively thick so that the corresponding legs 30 may slide on them in order to make the operating member 2 free from any rocking motion. With any of the above described arrangements, the actuating portion 25 is slidably held in contact with the actuated portion 35 of the resilient plate 3 received in the receiving hole 12 of the slider body 1.

The resilient plate 3 has a configuration same as those of the preceding embodiments and comprises the locking claw 33 at one end and the U-shaped spring 34 at the other end, a raised actuated portion 35 being formed therebetween. The front end of the U-shaped spring 34 has the oppositely extending lugs 36 at the front end thereof that come into engagement with the corresponding edges of the partition walls 20 while the front end is anchored by the small protuberance 19 when the resilient plate 3 is inserted into the narrow tubular receiving hole 12 from the open section 14 in the slider body 1 so that consequently the resilient plate 3 is held in position. Then, the legs 30 of the operating member 2 is introduced into the cavity section 21 of the slider body 1 as they are resiliently deformed and the bent sections 31 of the legs 30 are made to completely pass by the partition walls 20 until they get into the transversal groove 22, where they resiliently restore the original profiles to operate as the actuating portion 25 as they are held between the actuated portion 35 of the resilient plate 3 and the bottom of the receiving hole 12. The actuating portion 25 can be realized simply when the engaging protuberances 32 come into mutual engagement. The slider can be moved freely by moving the operating portion 24 back and forth as the actuating portion 25 pushes up the actuated portion 35 of the resilient plate 3 until the locking claw 33 is retracted and released from corresponding fastener elements.

What is claimed:

1. A slider for a slide fastener with an automatic locking mechanism, comprising;

(a) a slider body having an upper wing plate;

(b) an operating member; and (c) a resilient plate;

wherein a receiving hole for receiving said resilient plate is formed in said upper wing plate of the slider body;

wherein said resilient plate is provided with a locking claw at an end, a U-shaped spring at the opposite end and a raised actuated portion at the middle thereof, said locking claw of the resilient plate being retractably arranged in a guide groove provided in a lower wing plate of the slider body for guiding fastener elements;

wherein said operating member is provided with an actuating portion which is to be accommodated in said upper wing plate and held in sliding contact with said raised actuated portion of the resilient plate to operate said locking claw; and wherein the operating member is horizontally arranged and constrained so as to be movable back and forth without rotation relative to the slider body.

2. A slider for a slide fastener with an automatic locking me chan ism according to claim 1, wherein said receiving hole formed in the slider body has an enlarged open section extending from the rear opening of the slider body to a claw receiving hole and has a narrow tubular shape arranged above a guide post of the slider body into which the U-shaped spring is introduced, and said U-shaped spring is provided with lugs oppositely extending at a front end thereof and engaged with a corresponding edge of the receiving hole for receiving said resilient plate.

3. A slider for a slide fastener with an automatic locking mechanism according to claim 2, wherein a pair of partition walls are arranged oppositely along both sides of the receiving hole bored above said guide post of the slider body with a cavity section extending from the outside of the partition walls and from the claw receiving hole forwards and the operating member is inserted in said cavity section and held to be movable back and forth, said operating member having parallel legs extending from an operating portion exposed from the upper wing plate and bent at their front ends to produce bent sections operating as an actuating portion, the actuating portion being in sliding contact with the actuated portion of the resilient plate to operate the locking claw.

4. A slider for a slide fastener with an automatic locking mechanism according to claim 3, wherein said legs extending from the operating portion of the operating member in parallel with each other are made resilient and bent at the front ends to produce said bent sections, said bent sections being held in contact with each other and having respective engaging protuberances for resiliently engaging each other to operate as said actuating portion, said actuating portion being in sliding contact with the actuated portion of the resilient plate to operate the locking claw.

5. A slider for a slide fastener with an automatic locking mechanism according to claim 3, wherein said legs extending from the operating portion of the operating member in parallel with each other are bent at the front ends to produce said bent sections, said legs being resiliently deformed and introduced into the cavity section so as to arrange the bent sections vis-a-vis to operate as said actuating portion, said actuating portion being in sliding contact with the actuated portion of the resilient plate to operate the locking claw.

6. A slider for a slide fastener with an automatic locking mechanism according to claim 3, wherein a guard section is arranged above the cavity section at the side of a front opening of the upper wing plate of the slider body, extending forwardly and outwardly to cover said operating portion of the operating member fitted into the slider body.

7. A slider for a slide fastener with an automatic locking mechanism according to claim 1 or 2, wherein a through hole is formed to perpendicularly cross the longitudinal receiving hole for receiving said resilient plate, the operating member being introduced into said through hole so as to allow the operating member laterally slidable, and a cam surface is formed on the actuating portion of the operating member and held in sliding contact with the actuated portion of the resilient plate to operate the locking claw.

8. A slider for a slide fastener with an automatic locking mechanism according to claim 7, wherein thin and resilient legs are formed to have a U-shape extending from a front end of said cam surface of the actuating portion of the operating member, said thin and resilient legs are provided with projections at respective front ends thereof to engage inward protuberances arranged at the middle of the through hole running through the slider body, and spring plates are provided to extend respectively from opposite lateral ends of an operating portion exposed from the upper wing plate and engage a wide groove formed in the through hole.

9. A slider for a slide fastener with an automatic locking mechanism comprising;

(a) a slider body having an upper wing plate;

(b) an operating member; and (c) a resilient plate;

wherein a receiving hole for receiving said resilient plate is formed in said upper wing plate of the slider body;

wherein said resilient plate is provided with a locking claw at an end, a U-shaped spring at the opposite end and a raised actuated portion at the middle thereof, said locking claw of the resilient plate being retractably arranged in a guide groove provided in a lower wing plate of the slider body for guiding fastener elements;

wherein said operating member is provided with an actuating portion which is to be accommodated in said upper wing plate and held in sliding contact with said raised actuated portion of the resilient plate to operate said locking claw;

wherein the operating member is horizontally arranged so as to be movable back and forth relative to the slider body; and wherein said receiving hole formed in the slider body has an enlarged open section extending from the rear opening of the slider body to a claw receiving hole and has a narrow tubular shape arranged above a guide post of the slider body into which the U-shaped spring is introduced, and said U-shaped spring is provided with lugs oppositely extending at a front end thereof and engaged with a corresponding edge of the receiving hole for receiving said resilient plate.

10. A slider for a slide fastener with an automatic locking mechanism comprising;

(a) a slider body having an upper wing plate;

(b) an operating member; and (c) a resilient plate;

wherein a receiving hole for receiving said resilient plate is formed in said upper wing plate of the slider body;

wherein said resilient plate is provided with a locking claw at an end, a U-shaped spring at the opposite end and a raised actuated portion at the middle thereof, said locking claw of the resilient plate being retractably arranged in a guide groove provided in a lower wing plate of the slider body for guiding fastener elements;

wherein said operating member is provided with an actuating portion which is to be accommodated in said upper wing plate and held in sliding contact with said raised actuated portion of the resilient plate to operate said locking claw;

wherein the operating member is horizontally arranged so as to be movable back and forth relative to the slider body; and wherein a through hole is formed to perpendicularly cross the receiving hole for receiving said resilient plate, the operating member being introduced into said through hole so as to allow the operating member laterally slidable, and a cam surface is formed on the actuating portion of the operating member and held in sliding contact with the actuated portion of the resilient plate to operate the locking claw.

* * * * *

UNITED STATES PATENT AND TRADEMARK OFFICE

CERTIFICATE OF CORRECTION

PATENT NO. 6,112,375

DATED: September 5, 2000

INVENTORS: Kenji YUKI et al.

It is hereby certified that errors appear in the above-identified patent and that said Letters Patent is hereby corrected as shown below:

In Claim 2, col. 8, line 2, "me chan ism" should read --mechanism--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*